US009833880B1

(12) United States Patent
Dovel

(10) Patent No.: US 9,833,880 B1
(45) Date of Patent: Dec. 5, 2017

(54) HAND-HELD SHARPENER WITH MULTIPLE ABRASIVE RODS TO SHARPEN A CUTTING EDGE OF A TOOL

(71) Applicant: Darex, LLC, Ashland, OR (US)

(72) Inventor: Daniel T. Dovel, Shady Cove, OR (US)

(73) Assignee: Darex, LLC, Ashland, OR (US)

( * ) Notice: Subject to any disclaimer, the term of this patent is extended or adjusted under 35 U.S.C. 154(b) by 150 days.

(21) Appl. No.: 14/715,836

(22) Filed: May 19, 2015

Related U.S. Application Data

(63) Continuation of application No. 13/315,110, filed on Dec. 8, 2011, now Pat. No. 9,039,494.

(60) Provisional application No. 61/420,953, filed on Dec. 8, 2010.

(51) Int. Cl.
*B24D 15/08* (2006.01)
*B24B 3/54* (2006.01)

(52) U.S. Cl.
CPC ..... *B24D 15/08* (2013.01); *B24B 3/54* (2013.01)

(58) Field of Classification Search
CPC ..... B24B 3/54; B24D 15/02; B24D 15/06; B24D 15/065; B24D 15/08; B24D 15/081; B24D 15/082
USPC ..... 451/45, 344, 349, 552, 555, 556, 557, 451/558
See application file for complete search history.

(56) References Cited

U.S. PATENT DOCUMENTS 78,771 A 6/1868 Thayer
1,888,102 A 2/1931 Zahler
2,380,539 A * 7/1945 Miller ..... B24D 15/08 451/552
2,652,667 A * 9/1953 Arnold ..... B24D 15/08 451/555
3,719,461 A * 3/1973 Topping ..... B24D 15/06 451/540
3,735,542 A * 5/1973 Kocian ..... B24D 15/02 451/461
3,882,642 A 5/1975 Sykes
4,094,106 A * 6/1978 Harris ..... B24D 15/06 451/555
4,197,677 A * 4/1980 Graves ..... B24D 15/06 451/555
4,450,653 A * 5/1984 Fletcher ..... B24D 15/08 248/171
4,558,540 A * 12/1985 Collins ..... B24D 15/08 451/555
D287,095 S * 12/1986 Hunter ..... D8/71
(Continued)

*Primary Examiner* — Eileen Morgan
(74) *Attorney, Agent, or Firm* — Hall Estill Attorneys at Law

(57) ABSTRACT

A multi-rod hand-held sharpener. In some embodiments, the sharpener has a handle with opposing first and second ends, an outer grip surface, and a guide surface adjacent the first end extending at a selected angle with respect to a central axis. A first abrasive rod is adapted to extend from the first end of the handle in a selected direction parallel to the central axis and having a first outer abrasive surface with a first abrasiveness level, the first outer abrasive surface extending at a first non-orthogonal angle with respect to the guide surface. A second abrasive rod is adapted to extend from the first end of the handle in the selected direction and having a second outer abrasive surface with a different, second abrasiveness level. The second outer abrasive surface extends at a different, second non-orthogonal angle with respect to the guide surface.

22 Claims, 10 Drawing Sheets

(56) References Cited

U.S. PATENT DOCUMENTS 4,823,498 A * 4/1989 Banta ..... A01K 97/00 43/25
5,046,385 A * 9/1991 Cozzini ..... B24D 15/081 451/461
5,163,251 A * 11/1992 Lee ..... B24D 15/081 451/555
5,283,920 A * 2/1994 Plummer ..... A01K 97/00 43/4
5,458,534 A * 10/1995 Campione ..... B24D 15/08 451/540
6,039,642 A * 3/2000 Collins ..... B24D 15/06 451/45
6,048,262 A * 4/2000 Ray ..... B24D 15/08 451/524
6,101,898 A * 8/2000 Gore ..... B24D 15/065 76/82
6,129,616 A * 10/2000 Klotz ..... B24D 15/08 451/349
D444,691 S 7/2001 Ray
6,371,841 B1 * 4/2002 Ray ..... B24D 15/08 451/523
6,540,582 B1 * 4/2003 Primos ..... A01M 31/004 446/397
D484,019 S * 12/2003 Waltzer ..... D8/91
6,676,490 B1 * 1/2004 Kendhammer ..... B24D 15/08 451/45
D526,876 S * 8/2006 Smith ..... D8/93
D560,461 S 1/2008 Epstein
7,467,991 B2 12/2008 McCowen et al.
7,553,220 B2 * 6/2009 Smith ..... B24D 15/06 451/45
D604,134 S 11/2009 Smith et al.
8,221,199 B2 * 7/2012 Smith ..... B24B 3/54 451/461
8,267,749 B2 * 9/2012 Smith ..... B24D 15/08 451/349
8,512,105 B2 * 8/2013 Smith ..... B24B 3/54 451/461
8,591,294 B2 * 11/2013 Rieser ..... B24D 15/08 451/461
8,721,399 B1 * 5/2014 Huber ..... B24B 19/16 451/349
2006/0009141 A1 * 1/2006 Smith ..... B24D 15/08 451/540
2006/0194529 A1 * 8/2006 Smith ..... B24D 15/06 451/523
2008/0132159 A1 * 6/2008 Smith ..... B24D 15/084 451/557
2008/0171504 A1 * 7/2008 Smith ..... B24B 3/54 451/540
2009/0325473 A1 * 12/2009 Smith ..... B24D 15/08 451/555
2012/0270481 A1 * 10/2012 Smith ..... B24B 3/54 451/461
2013/0065494 A1 * 3/2013 Wu ..... B24D 15/082 451/344

* cited by examiner

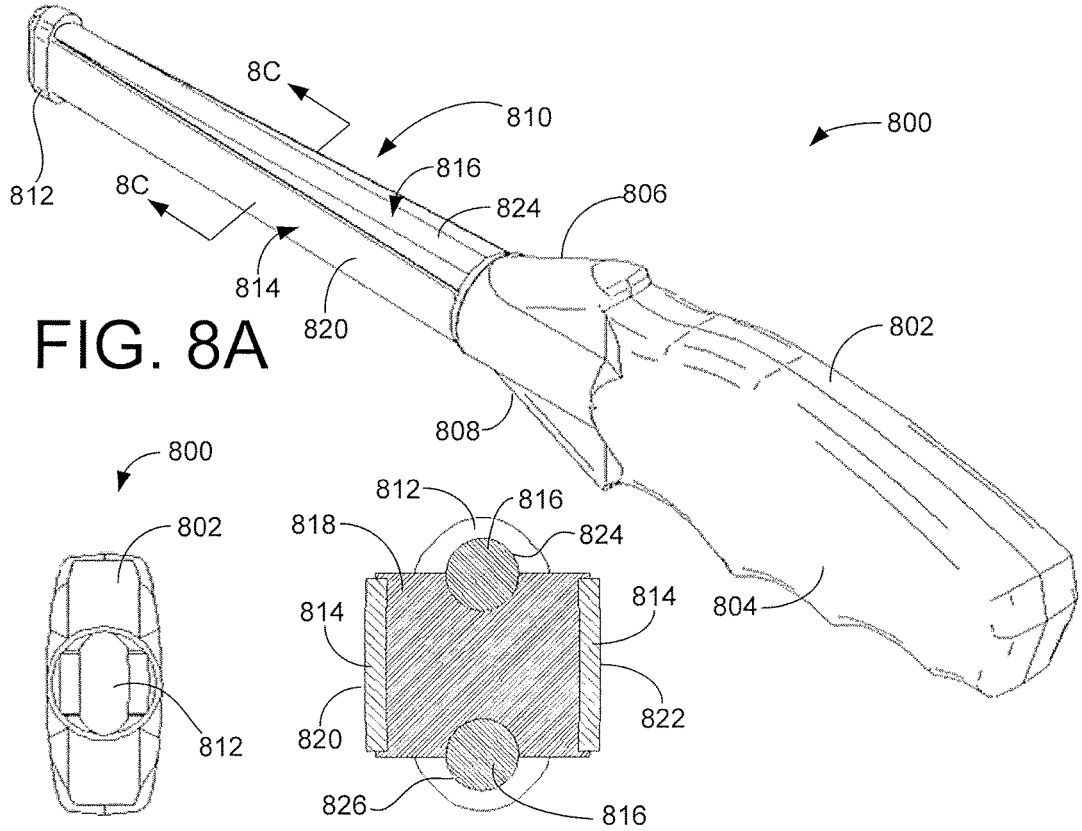
FIG. 8A
FIG. 8B
FIG. 8C
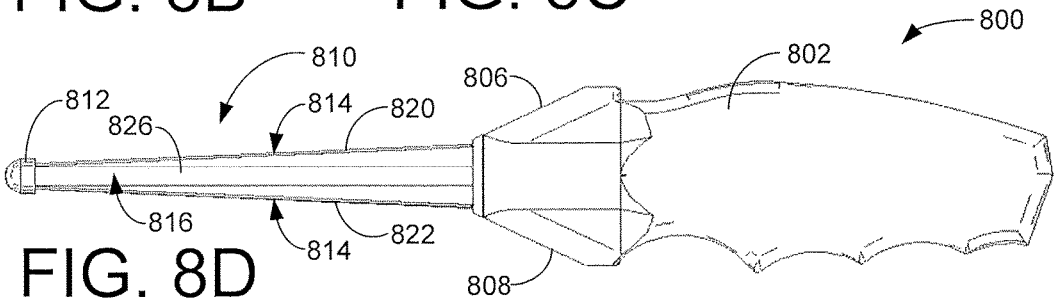
FIG. 8D
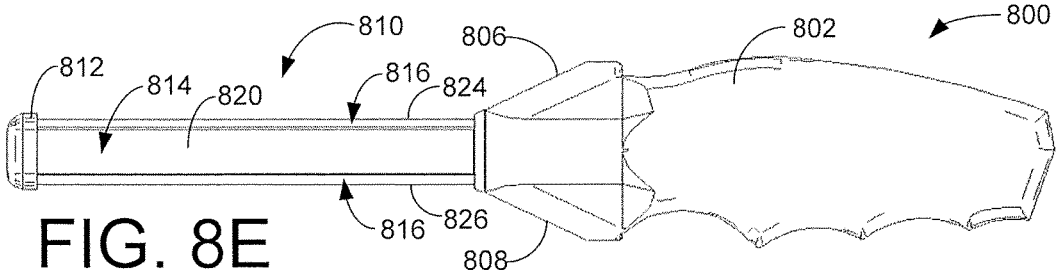
FIG. 8E

HAND-HELD SHARPENER WITH MULTIPLE ABRASIVE RODS TO SHARPEN A CUTTING EDGE OF A TOOL

RELATED APPLICATIONS

The present application is a continuation of co-pending U.S. patent application Ser. No. 13/315,110 filed Dec. 8, 2011, which makes a claim of domestic priority to U.S. Provisional Patent Application No. 61/420,953 filed Dec. 8, 2010, the contents of which are hereby incorporated by reference.

BACKGROUND

Cutting tools such as knives are used in a variety of applications to cut or otherwise remove material from a workpiece. A cutting tool often has one or more laterally extending, straight or curvilinear cutting edges along which pressure is applied to make a cut. The cutting edge is often defined along the intersection of opposing surfaces that intersect along a line that lies along the cutting edge.

Cutting tools can become dull over time after extended use, and thus it can be desirable to subject a dulled cutting tool to a sharpening operation to restore the cutting edge to a greater level of sharpness. A variety of sharpening systems adapted to carry out a sharpening operation are known in the art, including, but not limited to, grinding wheels, whet stones, abrasive cloths, abrasive belts and sharpening steels.

SUMMARY

Various embodiments of the present invention are generally directed to a multi-rod hand-held sharpener with multiple abrasive surfaces adapted to sharpen a cutting edge of a tool, such as a kitchen knife.

In some embodiments, a sharpener has a handle with opposing first and second ends and an outer grip surface disposed between said ends adapted to be gripped by a hand of a user during use of the sharpener to sharpen a cutting tool. The handle includes a guide surface adjacent the first end extending at a selected angle with respect to a central axis that extends through the first and second ends. A first abrasive rod is adapted to extend from the first end of the handle in a selected direction parallel to the central axis and having a first outer abrasive surface with a first abrasiveness level, the first outer abrasive surface extending at a first non-orthogonal angle with respect to the guide surface. A second abrasive rod is adapted to extend from the first end of the handle in the selected direction and having a second outer abrasive surface with a different, second abrasiveness level. The second outer abrasive surface extends at a different, second non-orthogonal angle with respect to the guide surface.

In other embodiments, a sharpener has a handle having opposing first and second ends and an outer grip surface disposed between said ends adapted to be gripped by a hand of a user during use of the sharpener to sharpen a cutting tool. The handle has a first guide surface adjacent the first end. A first abrasive rod extends from the first end of the handle and has a first abrasive surface which extends at a first intervening angle with respect to the first guide surface. A removable rod assembly has a second abrasive rod characterized as a tube adapted to slidingly engage the first abrasive rod and has a second abrasive surface. The removable rod assembly further has a second guide surface adapted to be aligned with the first guide surface upon engagement of the tube onto the first abrasive rod, the second guide surface extending at a second intervening angle with respect to the second abrasive surface.

In further embodiments, a sharpener has a handle with opposing first and second ends and an outer grip surface disposed between said ends adapted to be gripped by a hand of a user during use of the sharpener to sharpen a cutting tool. The handle has a first guide surface adjacent the first end extending at a selected angle with respect to a central axis which passes through the respective first and second ends. A combined rod assembly extends from the first end of the handle, the combined rod assembly having a first abrasive surface having a first abrasiveness level and which extends at a first angle with respect to the first guide surface and a second abrasive surface having a different, second abrasiveness level and which extends at a different, second angle with respect to the first guide surface.

These and other features and advantages that may characterize various embodiments can be understood with a review of the following detailed description section in conjunction with the associated drawings.

BRIEF DESCRIPTION OF THE DRAWINGS

FIG. 8A provides still another multi-rod hand-held sharpener in accordance with some embodiments.

FIG. 8B is an end elevational view of the sharpener of FIG. 8A.

FIG. 8C provides a cross-sectional view of the abrasive rod member of FIG. 8A as viewed along line 8C-8C in FIG. 8A FIG. 8D shows extension of the rod for sharpening against a first abrasive surface.

FIG. 8E shows extension of the rod for sharpening against a second abrasive surface.

DETAILED DESCRIPTION

Figure 1A:
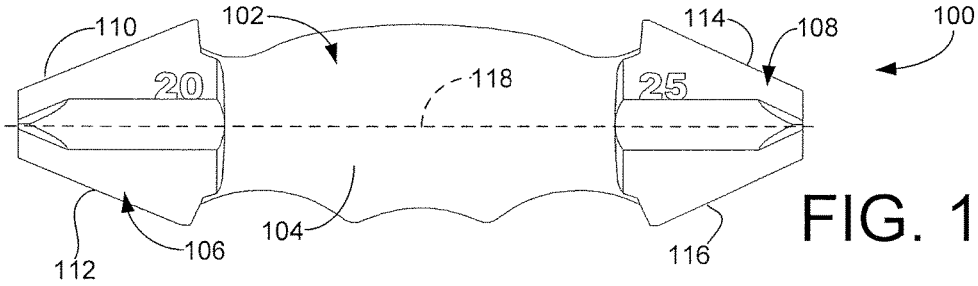
FIG. 1A provides a side elevational view of a multi-rod hand-held sharpener in accordance with some embodiments.

Various embodiments are generally directed to a multi-rod hand-held sharpening system adapted to sharpen cutting tools, such as but not limited to kitchen knives and the like.

The sharpening system may take the overall form of a sharpening steel, although such is not limiting. As will be recognized by the art, a sharpening steel is a style of sharpener that facilitates a manual sharpening operation upon a cutting tool. Generally, a sharpening steel is a "dirk-like" member having an elongated abrasive member that extends from a user handle. The blade of the cutting tool, such as a knife, is sharpened by drawing the blade axially down along and laterally across the abrasive member. The term "steel" denotes the general style, rather than the material composition, of the sharpener.

As embodied herein, the multi-rod hand-held sharpening system generally comprises a handle adapted to be gripped by a hand of a user, multiple abrasive rods adapted to extend from the handle to present multiple abrasive surfaces having different abrasiveness levels, and at least one guide surface adapted to establish a tool presentation angle for a tool.

In some embodiments, a different guide surface at a different angle is provided for each abrasive surface so that a first abrasive surface can be used to provide a coarse sharpening operation to impart a first sharpening angle to the tool, and a second abrasive surface can be used to provide a fine sharpening operation to impart a different, second sharpening angle to the tool, thereby forming a micro-bevel.

For reference, the term "abrasive" will be understood broadly to describe a medium adapted to carry out one or more of the following sharpening operations upon a cutting tool to enhance its cutting effectiveness: smoothing, shaping, straightening, deforming, polishing, burnishing, filing, abrading or otherwise altering some physical characteristic of the tool, irrespective of whether or not material is removed from the cutting tool during the sharpening process. The term "rod" will be understood broadly to describe a rigid, elongated member having a selected geometric configuration irrespective of material composition.

The various exemplary abrasive rods disclosed herein can take any number of suitable forms, such as but not limited to steel, carbide, ceramic or diamond coated abrasive. Multiple rods may be incorporated into a single elongated rod. The abrasive surfaces may be smooth or textured, cylindrical, flat, crowned, tapered, or take some other shape. A criss-crossing or otherwise ridged texture may be provided, or the surface(s) may be smooth without any human observable gaps, ridges or undulations. The abrasive surfaces may be subjected to hardening, coating or other processing to enhance sharpening characteristics. It is contemplated although not required that the abrasive surfaces will have a hardness that is greater than a hardness of the cutting tool blade and that the abrasive surfaces will exhibit little or no wear over time.

FIGS. 1A-1E show a multi-rod hand-held sharpener 100 constructed and operated in accordance with some embodiments. The sharpener 100 includes a handle 102 with an outer surface 104 sized and shaped to be grasped by a hand of a user. The outer surface 104 is disposed between opposing first and second ends 106, 108.

A first set of angled guide surfaces 110, 112 are disposed at the first end 106 of the handle. A second set of angled guide surfaces 114, 116 are disposed at the opposing second end 108. The guide surfaces are relatively long and narrow to allow clearance for the sharpening of the base portion of a blade next to the handle.

The respective sets of guide surfaces are angularly symmetric about a central longitudinal axis 118 of the handle 102, although such is merely illustrative and is not limiting. The respective sets of guide surfaces are shown to be at nominally the same non-orthogonal angle to the longitudinal axis 118 (e.g., 25 degrees), but this is also merely illustrative of some embodiments and is not limiting.

Figure 1B:
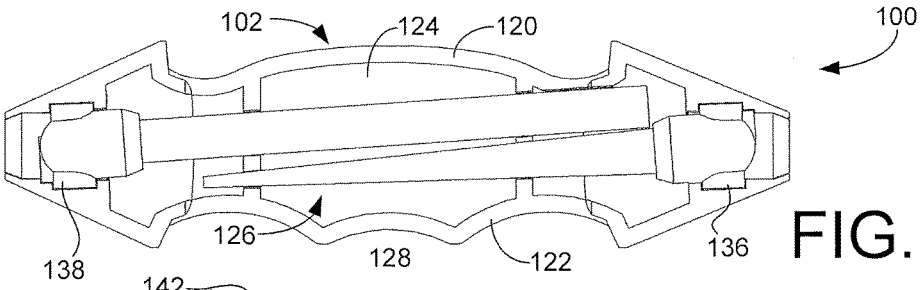
FIG. 1B shows the opposite side of the sharpener of FIG. 1A.
Figure 1C:
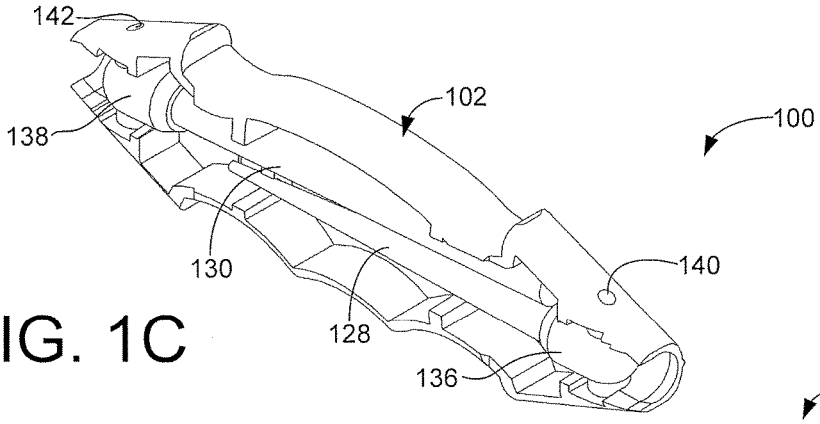
FIG. 1C is an isometric view of the sharpener of FIGS. 1A-1B.
Figure 1D:
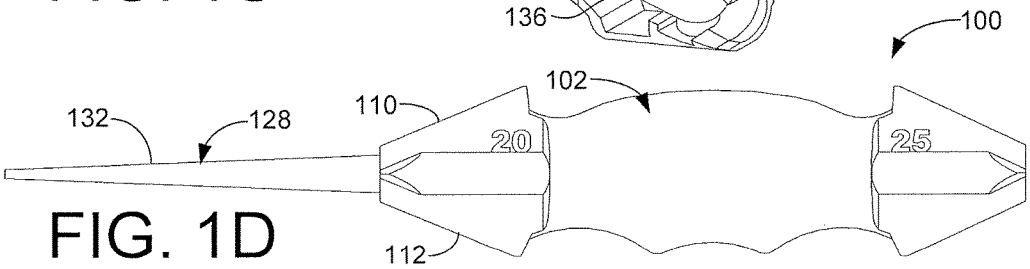
FIG. 1D is a side view corresponding to FIG. 1A in which a first abrasive surface is extended for sharpening.
Figure 1E:
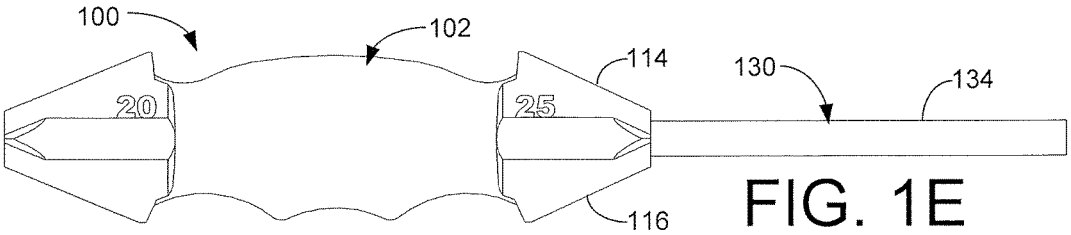
FIG. 1E is a side view corresponding to FIG. 1A in which a second abrasive surface is extended for sharpening.

FIG. 1B shows a second side of the sharpener 100 opposite to that of FIG. 1A. The handle 102 takes an "open frame" configuration with sidewalls 120, 122 which extend from a base web 124 to form a recess 126. The lower sidewall 122 can include indention channels to accommodate the fingers of the user as the outer surface 104 (FIG. 1A) is gripped.

First and second abrasive rods 128, 130 are disposed within the recess 126. A first abrasive surface 132 is provided on the first member 128, and a second abrasive surface 134 is provided on the second member 130. It is contemplated that the first and second abrasive surfaces will have different respective abrasiveness levels. In some embodiments, the first abrasive surface 132 has a relatively coarser abrasiveness (e.g., a lower grit value such as 80, etc.) and the second abrasive surface 134 has a relatively finer abrasiveness (e.g., a higher grit value such as 200, etc.).

The first and second members 128, 130 are hingedly affixed to the handle 102 via hinge assemblies 136, 138, so that the members can be rotated between retracted and extended positions via hinge pins 140, 142. The tapered rod 128 is shown in the extended position in FIG. 1D, and the cylindrical rod 130 is shown in the extended position in FIG. 1E.

FIGS. 2A-2D generally illustrate an exemplary sharpening sequence upon a kitchen knife 200 using the sharpener 100 of FIGS. 1A-1E. The knife 200 includes a knife handle 202, a knife blade 204 and a cutting edge 206 which longitudinally extends along a lower extent of the blade 204.

To sharpen the knife 200, a user grasps the handle 102 of the sharpener 100 with a firsthand 208 (such as the left hand), and rotates the first (tapered) rod 128 with a second hand 210 (such as the right hand) to place the tapered rod 128 into the extended position. The user next grasps the knife handle 202 with the second hand 210 and brings a side of the knife blade 204 into contacting engagement with a selected guide surface proximate the first rod, such as guide 110 or 112 (see FIG. 1D). The cutting edge 206 should be nominally in contact with the first abrasive surface 132 on the tapered rod at this point.

While maintaining the knife blade at this angular orientation established by the selected guide surface 110 or 112, the user advances the blade 204 along the tapered rod 128 while laterally drawing the blade across the rod along the length of the cutting edge 206. Some forward canting of the knife handle 202 may be required to ensure contact is made along the entirety of the cutting edge 206.

The user then repeats these steps using the remaining one of the blade guides 110, 112 so that both sides of the blade 204 are sharpened against the tapered rod 128. The user may rotate the knife 200 in the right hand 210 so as to access the remaining blade guide 110, 112 while continuing to support the handle 102 in the left hand 208. The user may further alternate strokes along opposing sides of the tapered rod a successive number of times, such as 3-5 times.

Continuing with the sharpening operation, the user sets the knife 200 aside, rotates the tapered rod 128 back into the retracted position within the handle 102, and extends the second (cylindrical) abrasive rod 130 from the handle. The user grasps the knife handle 202 with the second hand 210, and contactingly engages a side of the blade 204 against a selected one of the guide surfaces 114, 116 (see FIG. 1E).

The user thereafter advances the knife 200 along the second abrasive surface 134 of the cylindrical abrasive rod 130 while maintaining the knife in contact with the abrasive surface and oriented nominally at the presentation angle established by the selected guide surface. These steps may then be repeated using one of the remaining guide surfaces 114, 116 to sharpening the other side of the knife blade. As before, this may be repeated a suitable number times, such as 3-5 times or more.

It will be appreciated that the guide surfaces 110, 112, 114 and 116 serve to facilitate orientation of the knife 200 at respective presentation angles as the user contactingly engages a side of the knife blade 204 against the respective guide surface and a cutting edge 206 of the tool against the associated abrasive surface 132, 134.

The guide surface is further adapted to facilitate movement of the side of the blade away from the guide surface by the user as the cutting edge 206 is slidingly advanced against the respective abrasive surface while being maintained at the selected presentation angle of the guide surface. This is because the guide surface establishes the initial angular orientation of the knife, and the user is able to nominally maintain that angle as the knife is advanced away from the guide surface by taking care to not rotate the wrist or otherwise not shift the angular orientation of the blade during such movement.

The guide surface additionally provides a visual reference for the user; the user can visually compare the angle of the knife to the angle of the guide surface as the knife is moved across the abrasive surface and make adjustments as necessary to the rotational position of the knife to ensure the knife blade remains at the desired presentation angle.

Figure 2A:
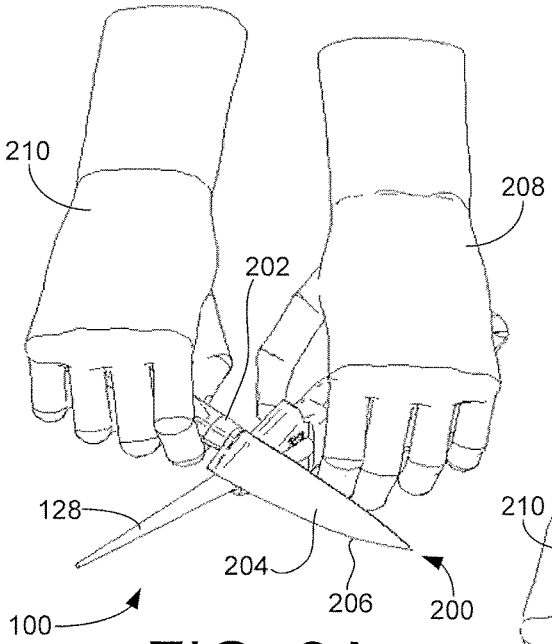
FIG. 2A illustrates a user sharpening a tool using the first abrasive surface of FIG. 1D.
Figure 2B:
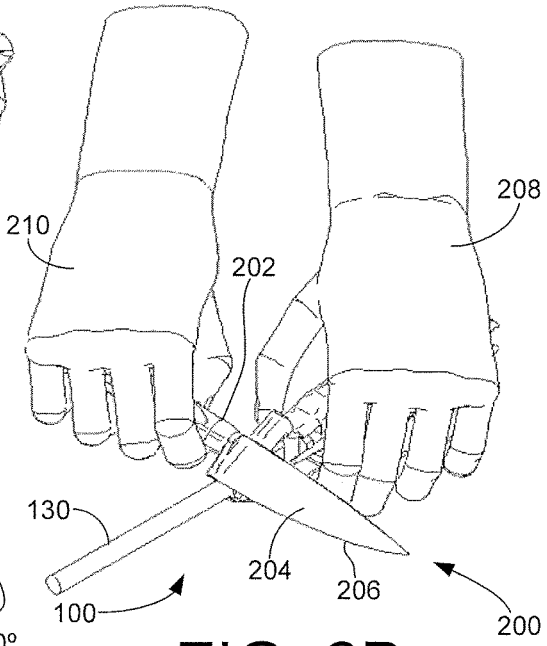
FIG. 2B illustrates the user sharpening a tool using the second abrasive surface of FIG. 1E.
Figure 2C:
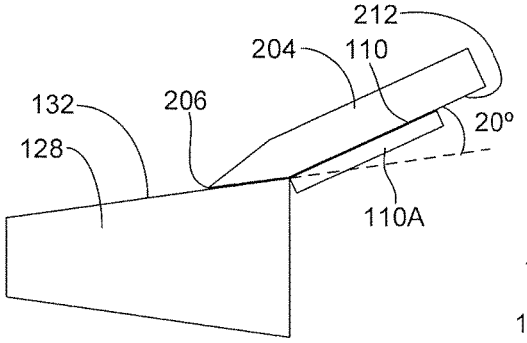
FIG. 2C is a schematic depiction of the relative orientation of the tool and the first abrasive surface.
Figure 2D:
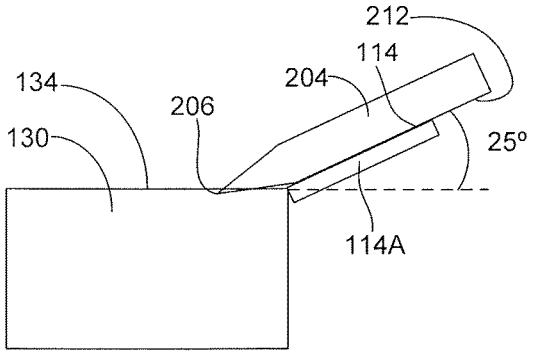
FIG. 2D is a schematic depiction of the relative orientation of the tool and the second abrasive surface.

This two stage sharpening operation is schematically illustrated in FIGS. 2C and 2D. FIG. 2C shows a portion of the tapered rod 128 adjacent a guide structure 110A that forms the guide surface 110. Similarly, FIG. 2D shows a portion of the cylindrical rod 130 adjacent a guide structure 114A that forms the guide surface 114. A selected side surface 212 of the blade 204 is respectively shown to be in contact with the associated guide surfaces 110, 114 in these figures.

Because of the tapered nature of the first abrasive surface 132, the effective presentation angle of the blade 204 relative to the first abrasive surface 132 is about 20 degrees (FIG. 2C). By contrast, the effective presentation angle of the blade 204 relative to the second abrasive surface 134 is about 25 degrees (FIG. 2D). Even though both guide surfaces 110 and 114 are both nominally at the same angle relative to the longitudinal axis 118 (FIG. 1A), these guide surfaces provide different sharpening angles, thereby forming a micro-bevel on the knife.

It will be appreciated that other angles, shapes and configurations for the sharpener 100 can be used to achieve micro-beveling. For example, both of the rods could be cylindrical (or other common shape) and the respective sets of guides 110, 112 and 114, 116 at opposing ends of the handle 102 could be oriented at different angles relative to the longitudinal axis 118 to impart different sharpening angles to the knife. Alternatively, while the tapered rod 128 takes a frusto-conical shape of decreasing diameter in a direction away from the handle, this orientation could be reversed so that the diameter decreases in a direction towards the handle.

Moreover, while the use of different sharpening angles to impart micro-beveling is illustrated, in further embodiments the sharpener 100 of FIGS. 1A-1E may be configured to provide multiple rods that impart nominally the same sharpening angle to the tool. In this latter case, the first abrasive surface establishes an overall geometry for the cutting edge and adjacent surfaces, and the second abrasive surface serves to hone, polish or otherwise straighten these surfaces.

It is contemplated in FIGS. 2A-2D that the tapered rod provides a coarse sharpening operation in which relatively larger amounts of material are removed from the knife blade, and the cylindrical rod provides a fine sharpening operation which relatively smaller amounts of material are removed from the blade. In such case, the primary sharpening operation may not be required every time the knife 200 is sharpened; rather, once the knife has been sharpened using both primary and secondary stages, the knife 200 may be returned to its former sharpness after use by simply employing the second stage.

FIGS. 3A-3G illustrate another multi-rod hand-held sharpener 300 in accordance with some embodiments. The sharpener 300 is similar to the sharpener 100 and may be utilized as discussed above to provide multi-rod sharpening of the knife 200, including micro-beveling thereof. The sharpener 300 includes a handle 302 with outer grip surface 304, opposing first and second ends 306, 308, and respective sets of guide surfaces 310, 312 and 314, 316.

A tapered abrasive rod 318 is affixed for rotation between a retracted position (FIG. 3C) and an extended position (FIG. 3E) via hinge assembly 320 having a hinge pin 322. A cylindrical abrasive rod 324 is configured for sliding movement between a retracted position (FIG. 3C) and an extended position (FIGS. 3D and 3F) via end stops 326, 328 which are disposed at respective proximal and distal ends of the cylindrical rod 324.

A third sharpening stage is provided by a cover member 330 hingedly affixed to the handle 302. The cover member 330 may be rotated from a retracted position (FIG. 3C) to an extended position (FIG. 3D) and is characterized as a flat abrasive rod. It will be appreciated that the outer surface of the cover member 330 forms a portion of the user grip surface 304 when in the retracted position, but not when the cover member has been opened to the extended position.

The tapered abrasive rod 318, the cylindrical abrasive rod 324 and the flat abrasive rod (cover) member 330 each respectively include first, second and third abrasive surfaces 332, 334 and 336. This can provide three different levels of abrasiveness for various sharpening operations.

In some embodiments, the first and second abrasive surfaces 332, 334 are arranged to provide coarse and fine sharpening operations as discussed above in FIGS. 2A-2D. The third abrasive surface 336 may be configured to provide relatively coarser sharpening, such as in the form of a planar file surface, sharpening stone or similar abrasive block configuration to facilitate the repair or reshaping of a broken knife blade. Alternatively, the third abrasive surface 336 may be finer in abrasiveness level than that of the tapered and cylindrical rods to provide honing or polishing after the secondary sharpening operation, such as in the form of a leather strope or other fine abrasive media.

Figure 3A:
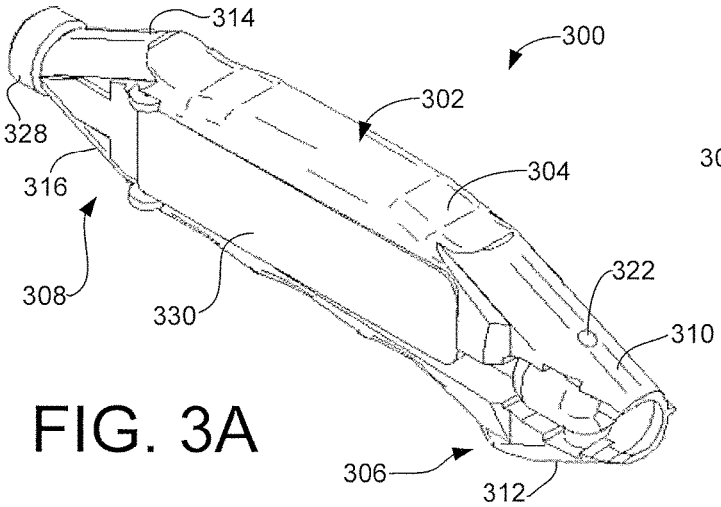
FIG. 3A is an isometric depiction of a multi-rod sharpener in accordance with further embodiments having first, second and third abrasive surfaces.
Figure 3B:
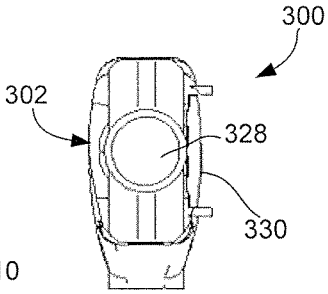
FIG. 3B is an end elevational view of the sharpener of FIG. 3A.
Figure 3C:
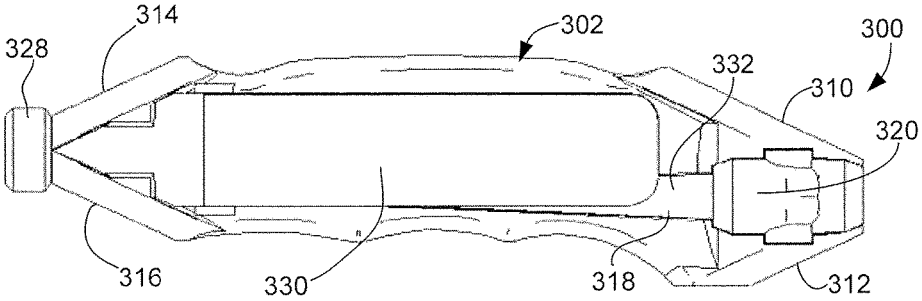
FIG. 3C shows a side elevational view of the sharpener of FIGS. 3A-3B.
Figure 3D:
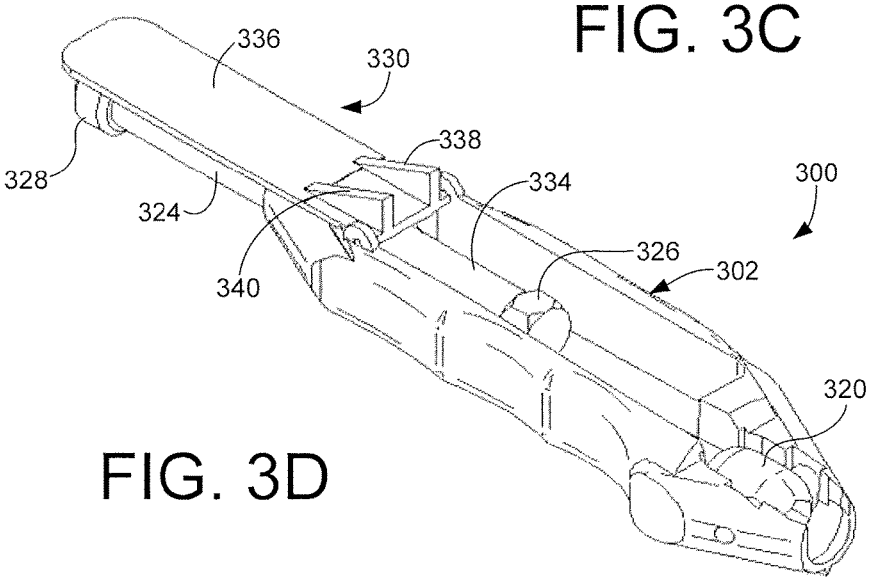
FIG. 3D illustrates a flip open cover of the sharpener to expose a third abrasive surface of the sharpener.
Figure 3E:
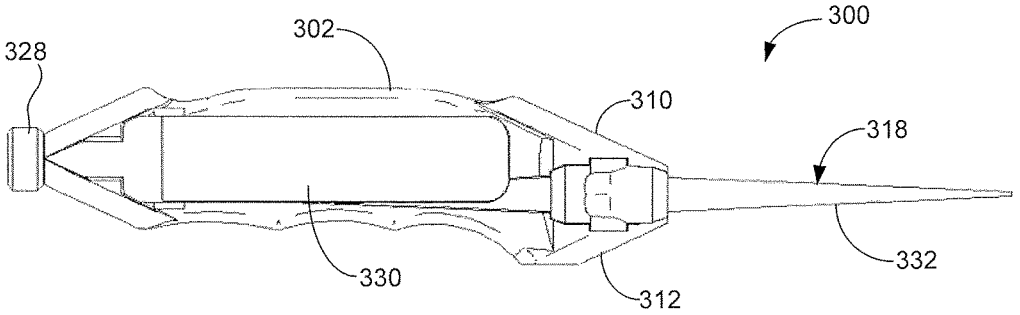
FIG. 3E illustrates extension of a first abrasive surface.

Guide surfaces 338, 340 may extend from the cover member 330 at a suitable presentation angle adjacent the third abrasive surface 336 for use as desired in orienting the tool. The cylindrical rod 324 may be extended as shown in FIG. 3D so as to support the third abrasive surface 336 via the limit stop 328. The cover member 330 can be readily incorporated into other embodiments of sharpener disclosed herein.

Figure 3F:
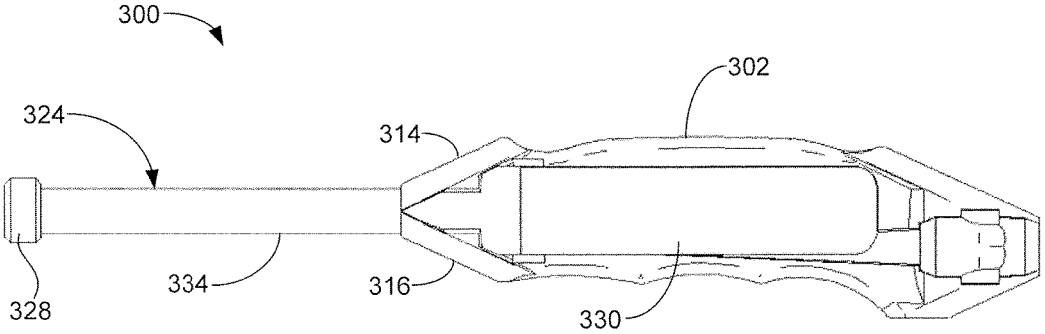
FIG. 3F illustrates extension of a second abrasive surface.
Figure 3G:
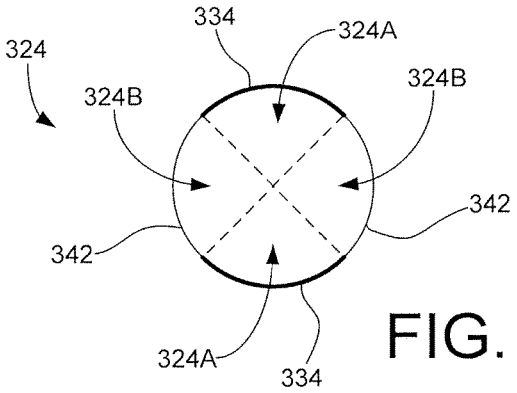
FIG. 3G is a cross-sectional view of a selected one of the rods extended in FIG. 3E or 3F to illustrate multiple abrasive surfaces thereon, the rod thereby forming multiple integrated abrasive rods.

FIG. 3G shows the cylindrical rod 324 as having a multi-rod configuration composed of abrasive rods 324A and 324B each having a general wedge cross-sectional shape. The second abrasive surface 334 is shown to extend along outer surfaces of the rods 324A. A fourth abrasive surface 342 is shown to extend along outer surfaces of the rods 324B. The abrasiveness level of the fourth surface 342 is different from the abrasiveness level of the second surface 334. For example, the abrasive level of surface 334 might be 200 grit and the abrasive level of surface 342 might be 800 grit. Other suitable values could be used.

In this way, the cylindrical rod member 324 forms a plurality of rods which are separately selectable by the user through rotation of the member within the handle 302 to align the respective abrasive surfaces 334 and 342 with the guide surfaces 314, 316 (FIG. 3F). The use of multiple rods within the same unitary rod can enhance the effectiveness of the sharpener by providing additional abrasiveness levels for different applications.

The respective wedges can be separately formed and bonded together to form the unitary rod 324, or the rod can be uniformly made of a common material (e.g., ceramic, etc.) and the surface quadrants respectively processed to form the rods 324A, 324B. The tapered rod 332 can take a similar multi-rod configuration, as can other abrasive rods disclosed herein. The respective abrasive surfaces 334, 342 can be color coded or otherwise marked with user-readable indicia to allow easy selection of the desired abrasiveness level by the user.

FIGS. 4A-4F generally illustrate another multi-rod hand-held sharpener 400 in accordance with some embodiments. The sharpener 400 is similar to the sharpener 300 discussed above and includes a handle 402 with outer grip surface 404, tapered rod 406, cylindrical abrasive rod 408, and flip-cover member 410. Associated abrasive surfaces are denoted at 412, 414 and 416.

Figure 4A:
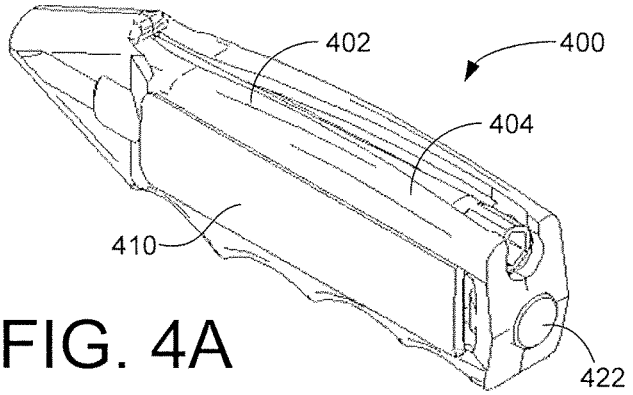
FIG. 4A is an isometric depiction of a multi-rod hand-held sharpener in accordance with further embodiments.
Figure 4B:
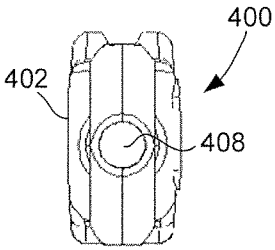
FIG. 4B is an end elevational view of the sharpener of FIG. 4A.
Figure 4C:
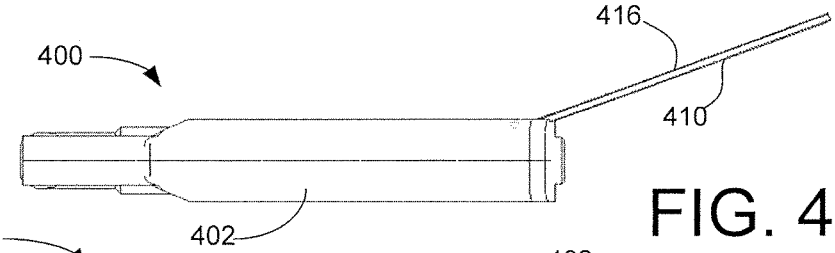
FIG. 4C shows a top view of the sharpener with a flip cover rotated to an open position to expose an abrasive block surface.
Figure 4D:
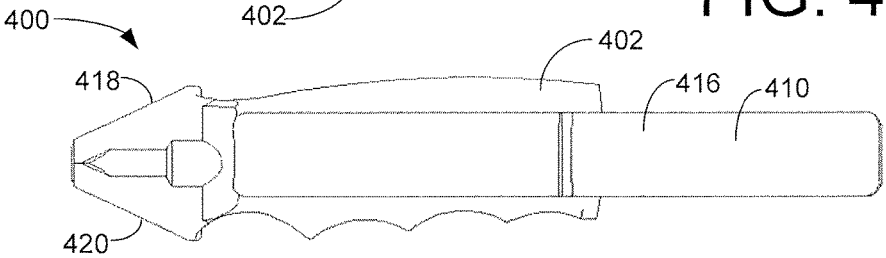
FIG. 4D is a top plan view of FIG. 4C.
Figure 4E:
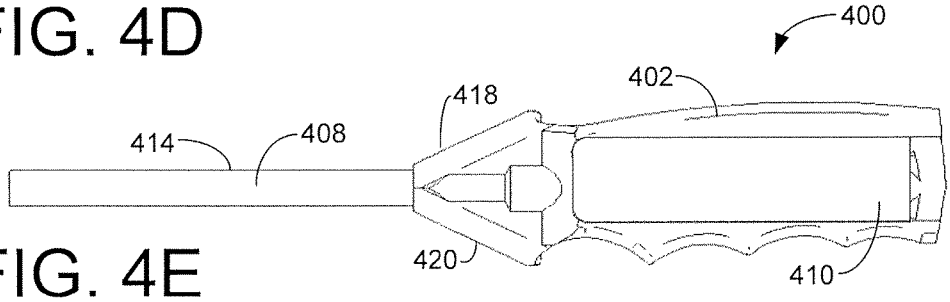
FIG. 4E shows extension of a first abrasive surface.
Figure 4F:
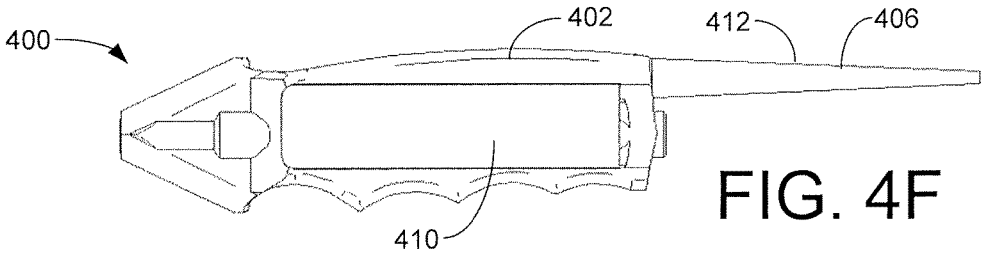
FIG. 4F shows extension of a second abrasive surface.

Upper and lower guide surfaces 418, 420 extend adjacent the cylindrical abrasive rod 408, although guide surfaces are not provided adjacent the tapered abrasive rod 406. The abrasive surface 416 may be along the inside of the cover member, allowing the handle housing to be used as a guide surface (FIG. 4C). The respective angles of the guide surfaces 418, 420 may be configured relative to the angle of the cover to provide micro-beveling as discussed above.

An elastomeric button 422 may be provided at the proximal end of the cylindrical rod 408 to facilitate extension and retraction of the member 408. As with other embodiments disclosed herein, the tapered abrasive rod 406 may be rotated between retracted and extended positions, and may be used in the extended position to provide sharpening of particular cutting tool features such as serrations, etc.

FIGS. 5A-5D provide yet another multi-rod hand-held sharpener 500 in accordance with some embodiments. As before, the sharpener 500 includes a handle 502 with an outer grip surface 504, guide surfaces 506, 508 along a first end 510 of the handle, and respective first and second abrasive rods 512, 514 adapted for extension adjacent the first end 510.

The first abrasive member 512 is characterized as a tapered rod with a first abrasive surface 516. The tapered rod 512 is normally housed within an interior of the handle 502 when not in use. The tapered member 512 may be slidingly retrieved from an opposing second end 518 of the handle 502 and inserted into an aperture in the first end 510 adjacent the guide surfaces 506, 508 for primary sharpening operations at a first sharpening angle.

Figure 5A:
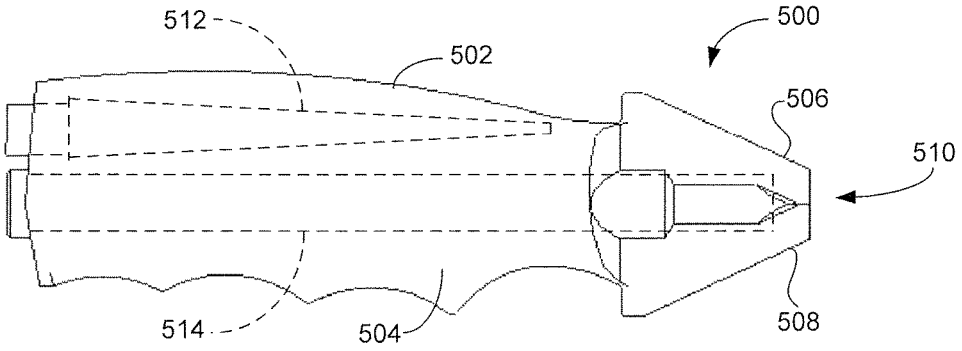
FIG. 5A illustrates yet another multi-rod hand-held sharpener in accordance with some embodiments.
Figure 5B:
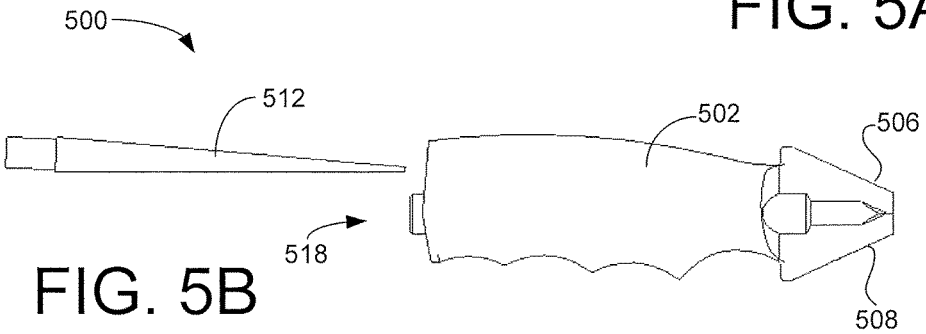
FIG. 5B shows removal of a tapered rod from a first end of the sharpener.
Figure 5C:
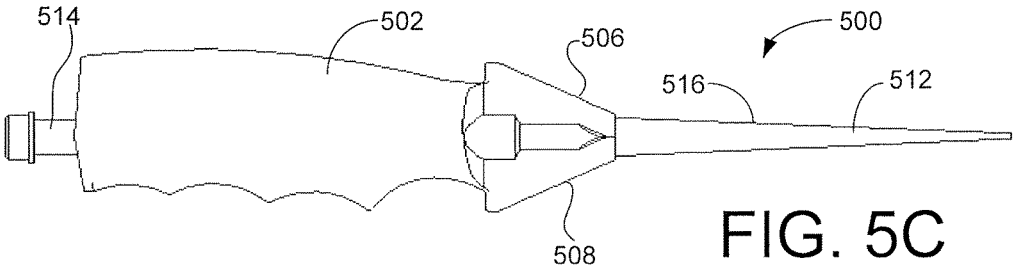
FIG. 5C illustrates coupling of the tapered rod to a second end of the sharpener.
Figure 5D:
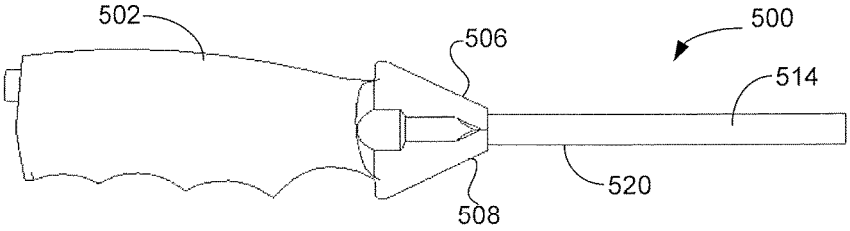
FIG. 5D shows extension of a cylindrical rod from the second end.

The second abrasive member 514 is characterized as a cylindrical rod with a second abrasive surface 520. The cylindrical rod 514 is also normally housed within an interior of the handle 502 when not in use, and slidingly extended through the aperture at the first end 510 for secondary sharpening operations at a second sharpening angle. As before, an elastomeric button 522 can be disposed at a proximal end of the cylindrical rod 520 to facilitate user depression to transition to the extended position. It is contemplated, albeit not required, that the insertion of the tapered rod may induce some displacement of the cylindrical rod, as generally depicted in FIG. 5C.

Micro-beveling operations as discussed above can be readily performed using the different respective rods 512, 514 and same guide surfaces 506, 508. A third stage cover-type rod configuration can be incorporated into the sharpener 500, as discussed previously in FIGS. 3-4. The respective rods can be further provided with multi-rod configurations so as to each provide multiple abrasive surfaces with different abrasiveness levels, to further increase the available number of sharpening stages.

Figure 6A:
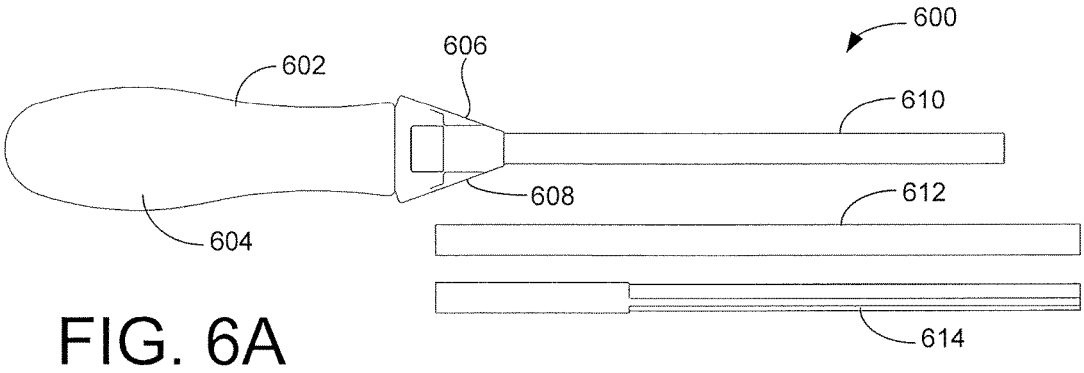
FIG. 6A shows a multi-rod hand-held sharpener in accordance with further embodiments.
Figure 6B:
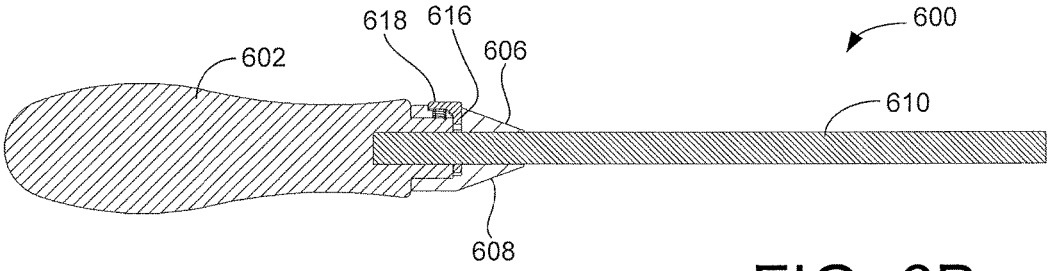
FIG. 6B is a cross-sectional depiction of FIG. 6A.
Figure 6C:
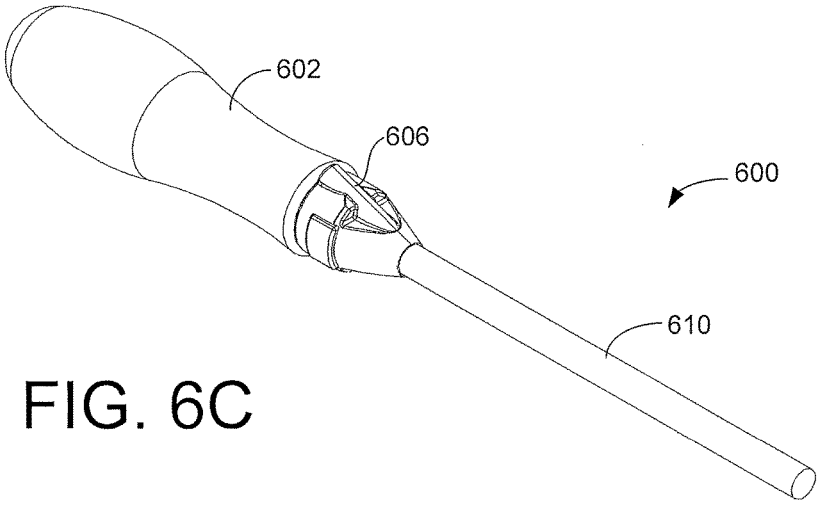
FIG. 6C is an isometric view of FIG. 6A.

FIGS. 6A-6C depict still another multi-rod hand-held sharpener 600 in accordance with some embodiments. The sharpener 600 is characterized as having a handle 602 with a user grip surface 604, guide surfaces 606, 608, and a number of different, interchangeable abrasive rods such as 610, 612 and 614 each having one or more abrasive surfaces.

These rods are each removeably insertable into the handle as generally depicted in FIG. 6B via a spring loaded collar mechanism 616 with a user depressible tab 618.

The respective rods can be provided with the same overall shape (e.g., cylindrical rods 610 and 612) or with different shapes (e.g., irregular rod 614). Other shapes may be used as well, including a tapered (frusto-conical) rod as discussed above to provide micro-beveling. Each abrasive surface may be provided with a different abrasiveness level.

Figure 7A:
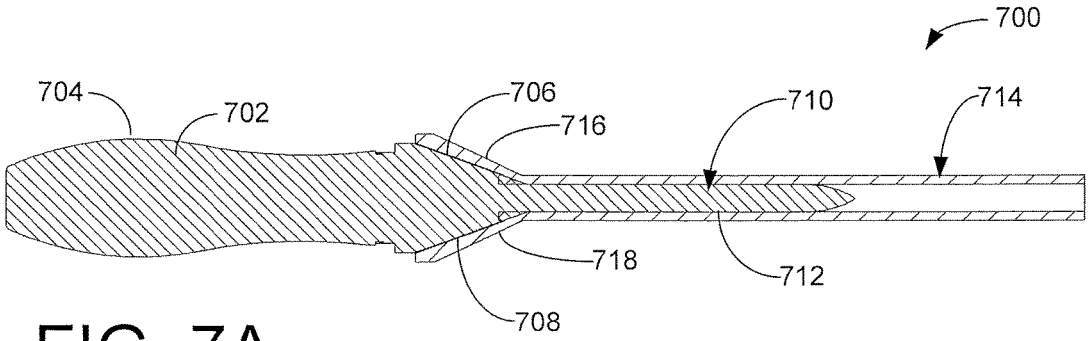
FIG. 7A shows a cross-sectional view of yet another multi-rod hand-held sharpener in accordance with some embodiments.
Figure 7B:
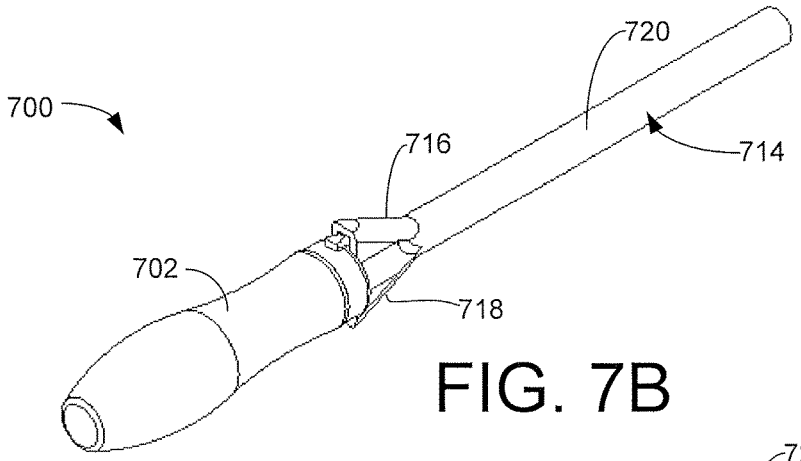
FIG. 7B is an isometric depiction of FIG. 7A.
Figure 7C:
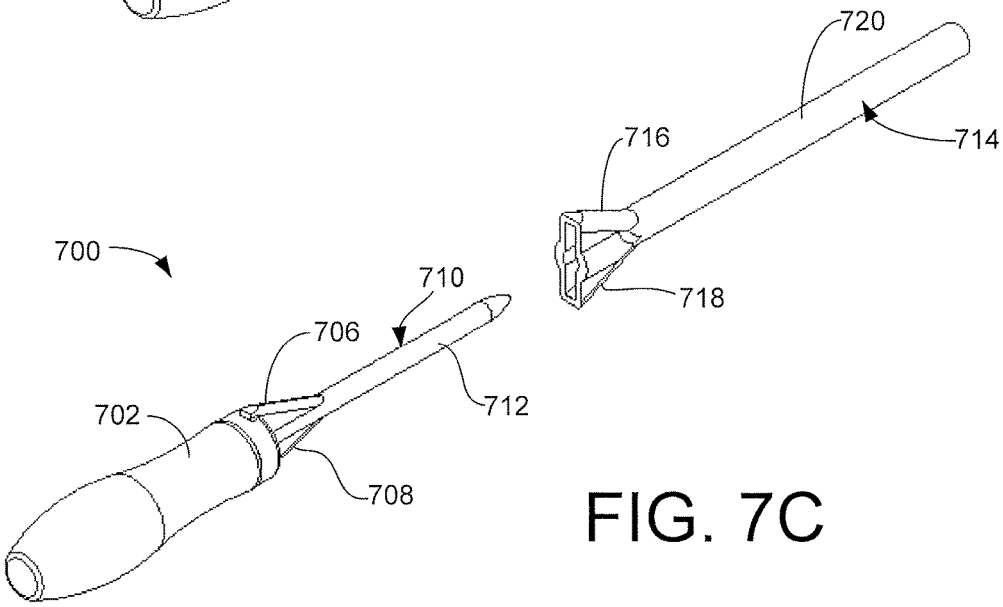
FIG. 7C is an exploded isometric depiction of FIG. 7A.

FIGS. 7A-7C illustrate yet another multi-rod hand-held sharpener 700 in accordance with some embodiments. The sharpener 700 is similar to the sharpener 600 and includes a base unit with a handle 702 having user grip surface 704 and a first set of guide surfaces 706, 708, and a first abrasive rod 710 which extends from the handle 702 adjacent the guide surfaces 706, 708. The first abrasive rod is provided with an outer abrasive surface 712 of selected grit.

A second abrasive rod 714 is characterized as a slip-on hollow rod and is adapted to engage the base unit as shown. The second member 714 includes a second set of guide surfaces 716, 718 at one end thereof and a second abrasive surface 720 of selected grit. While not limiting, the first guide surfaces 706, 708 provide a first sharpening angle (e.g., 20 degrees, etc.) and the second guide surfaces 716, 718 provide a second sharpening angle (e.g., 25 degrees, etc.) to facilitate micro-beveling as discussed above. It will be appreciated that slip-on members such as 714 can be readily adapted for use with the other embodiments disclosed herein.

FIGS. 8A-8E depict another embodiment for a multi-rod hand-held sharpener 800. The sharpener 800 includes a handle 802 with outer grip surface 804 adapted to be gripped by a hand of a user. Opposing guide surfaces 806, 808 are provided at a first end of the handle 802. An abrasive rod 810 can be slidingly retracted into and extended from the handle 802 as required using a user-engageable limit stop 812 at a distal end of the member. Such extension and retraction is not required, however.

FIG. 8C provides a cross-sectional view of the abrasive rod 810 as viewed along line 8C-8C in FIG. 8A. The abrasive rod 810 takes a multi-rod configuration including opposing first and second tapered rods 814, opposing first and second cylindrical rods 816, and a central support rod 818. The tapered rods 814 may be flat or may have a slight crowning (e.g., relatively large radius of curvature).

The member 810 may be formed in a variety of suitable ways. In some embodiments, the individual rods 814, 816 are initially formed and then molded in place using an injection molding operation so that the support rod 818 constitutes an injection moldable plastic or similar material. In other embodiments, the member 810 may be formed of a uniform material that is extruded, machined, molded or otherwise processed to provide the overall shape shown in FIG. 8C. It will be appreciated that other cross-sectional shapes and side profiles can be readily implemented as desired.

Outer abrasive surfaces are provided at 820, 822 on the tapered rods 814, and outer abrasive surfaces are provided at 824, 826 on the cylindrical rods 816. It is contemplated that the abrasiveness levels of the surfaces 820, 822 will be the same, the abrasiveness levels of the surfaces 824, 826 will be the same, and the surfaces 820, 822 will be different from, and have a finer grit than, the surfaces 824, 826. This is merely exemplary, however, as any suitable combinations of abrasiveness levels can be selected for the various surfaces.

The abrasive rod 810 is contemplated as being rotatable with respect to the housing 802. This facilitates presentation of the surfaces 820, 822 adjacent the guide surfaces 806, 808 in a first (e.g., coarse) sharpening operation (FIG. 8D), and presentation of the surfaces 824, 826 adjacent the guide surfaces 806, 808 in a second (e.g., fine) sharpening operation (FIG. 8E). Because of the tapered nature of the rods 814, different sharpening angles will be imparted as generally discussed above in FIGS. 2C-2D to provide micro-beveling. As before, an abrasive cover member can be incorporated into the side of the handle 802 as desired to provide additional sharpening capabilities.

FIGS. 9A-9D illustrate various features associated with the foregoing embodiments. Another exemplary knife that can be readily sharpened by the sharpeners discussed above is shown at 900 in FIG. 9A. The knife 900 includes a user handle 902 and a blade 904. The knife 900 can be sharpened by each of the various embodiments disclosed herein against an abrasive rod 906 by concurrently advancing the knife in an axial direction 908 while drawing the knife laterally across the rod 906 in a lateral direction 910. In this way, the entire length of the blade contactingly engages the rod. The user maintains the knife at the same reference orientation established by associated rod guide surface (not shown).

The blade 904 may be formed of any suitable material such as high carbon content stainless steel. While the knife 900 is a single bladed knife that tapers to a single cutting edge 912 (as shown in FIG. 9B), it will be noted that double bladed knives, as well as other types of cutting tools, can be readily sharpened by these systems by sharpening each cutting edge at a time.

Figure 9A:
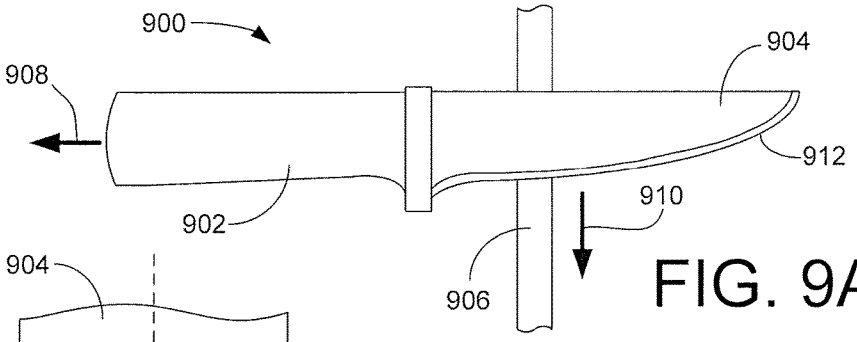
FIG. 9A depicts a cutting tool being presented for sharpening against an abrasive surface.
Figure 9B:
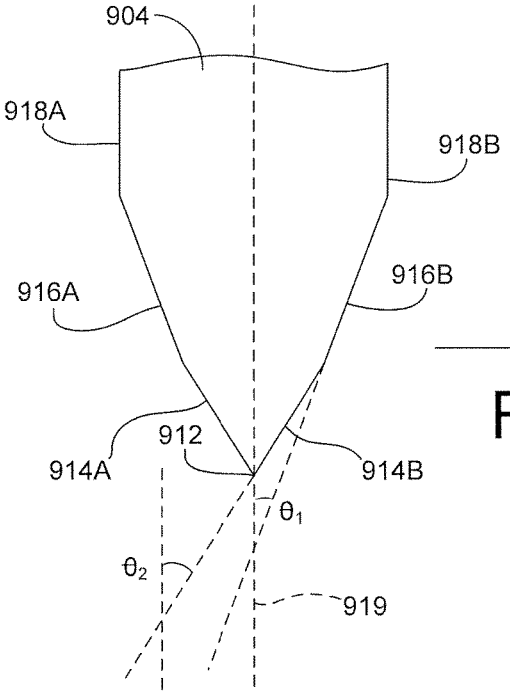
FIG. 9B is a cross-sectional elevational view of a distal cutting edge of the cutting tool of FIG. 9A.

The blade 904 in FIG. 9B is shown to have a micro-beveled configuration with respective beveled side surfaces 914A and 914B, beveled side surfaces 916A and 916B, and opposing parallel side surfaces 918A and 918B. The beveled surfaces 916A-B taper at a first sharpening angle $\theta_1$, and the beveled surfaces 914A-B taper to a second, greater sharpening angle $\theta_2$. These angles are relative to a centerline 919 that passes through the center of the blade 904 and through the cutting edge 912 as shown.

Suitable values for these sharpening angles of the knife 900 may be on the order of around 20 degrees for the first angle $\theta_1$ and 25 degrees for the second angle $\theta_2$, although other angles can be used. The shallower angle $\theta_1$ enhances cutting strength and sharpness, and the deeper angle $\theta_2$ improves durability of the cutting edge 912. The respective axial lengths of the angled surfaces can vary as required so that the various aspect ratios and dimensions are merely representative and not limiting.

Figure 9C:
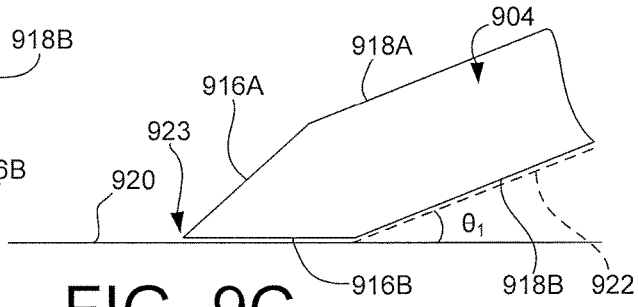
FIG. 9C depicts presentation of the cutting tool against a first abrasive surface as depicted in FIGS. 1-8.

FIG. 9C generally represents a first stage sharpening operation in accordance with the foregoing embodiments. In FIG. 9C, the knife 900 is presented by the user against a first abrasive surface 920 to establish the first angle $\theta_1$. While not limiting, it is contemplated that the first abrasive surface 920 may correspond to a selected one of the abrasive surfaces of the various tapered rods discussed above, such as the abrasive rod 128 in FIGS. 1A-1E.

Generally, the knife may be presented at the first angle $\theta_1$ by a first guide surface 922 (denoted by dashed lines). This first guide surface may be provided by a guide surface adjacent the various tapered rods discussed above, such as but not limited to the guide surfaces 110, 112 in FIGS. 1A-1E.

The contacting engagement of the knife against the first abrasive surface 920 will generally operate to remove relatively large amounts of material from the edge of the blade 904. Depending on the amount of material removed, the previously existing cutting edge and side surfaces may disappear and new ones formed. During this primary (coarse) sharpening, the beveled surfaces 916A and 916B will be formed and may extend to the end of the blade material and meet to form a first cutting edge 923.

Figure 9D:
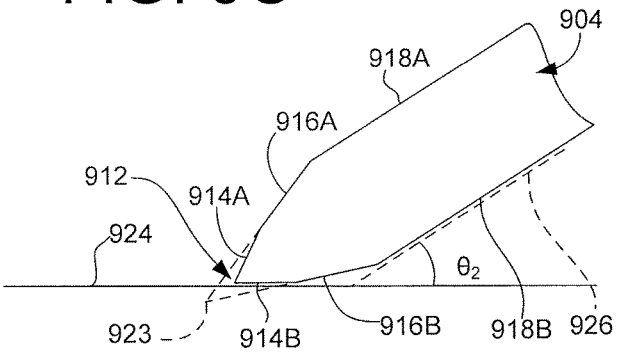
FIG. 9D depicts presentation of the cutting tool against a second abrasive surface as depicted in FIGS. 1-8.

FIG. 9D generally represents a second stage sharpening operation in accordance with the foregoing embodiments. In FIG. 9D, the blade 904 is subsequently presented by the user against a second abrasive surface 924 to establish the second angle $\theta_2$. Without limitation, this second abrasive surface may be provided by any of the cylindrical rods discussed above such as the rod 134 in FIGS. 1A-1E. A suitable guide surface 926 can be used to set this angle, such as the guides 114, 116. Other configurations can be used, however. For example, one or more reference guide surfaces can be disposed in other locations, such as but not limited to a position adjacent the distal end of an abrasive rod opposite the handle.

The second stage sharpening operation depicted in FIG. 9D generally operates to remove material from the distal end of the tip of the blade 904, thereby forming the side surfaces 914A-B and the cutting edge 912.

It will be appreciated that, given sufficient time and repetitive sharpening strokes, a dull blade could be honed to form the side surfaces 914A-B and cutting edge 912. However, it has been found that, in the case of a particularly dull, damaged or worn knife, that portion of the knife proximate the cutting edge may not contactingly touch the abrasive, so that the sharpening operation serves as a side-honing operation without affecting the characteristics of the cutting edge.

The various embodiments discussed above have largely relied on cylindrical and frusto-conical shaped rods. Other shapes and forms of elongated members can be used. For example, FIG. 10 shows a number of alternative cross-sectional shapes of elongated members that can be readily incorporated into the foregoing embodiments.

Figure 10:
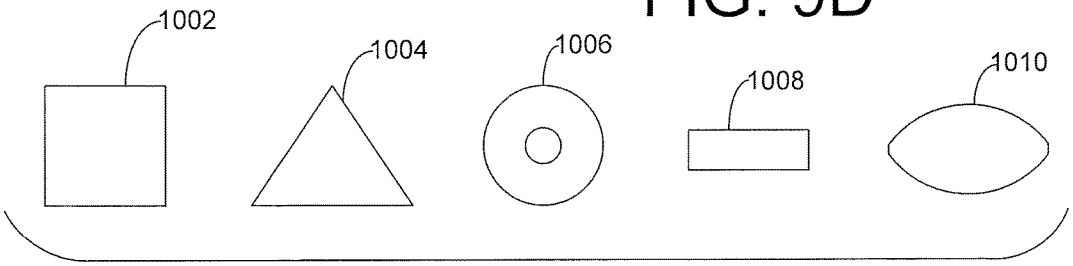
FIG. 10 shows alternative cross-sectional shapes for the various abrasive rods depicted in FIGS. 1-8.

The views in FIG. 10 correspond to an end view (looking toward the distal end of the respective members). These alternatives include a square shaped member 1002, a triangularly shaped member 1004, a frusto-conical (tapered) member 1006, a rectilinearly shaped member 1008 and a curvilinearly shaped member 1010. Other shapes and forms can be used, including hollow members. While it has been contemplated that the abrasive surface of the second sharpening stage will extend fully around the outer surface of the elongated member, such is not necessarily required. It will be appreciated that associated rod guide surfaces can be disposed at various angular orientations corresponding to the various surfaces in FIG. 10.

Accordingly, a multi-rod hand sharpener as disclosed herein can be beneficial in sharpening the blade of a cutting tool. It has been found that sharpeners configured as described herein can quickly and easily impart razor or "scary" sharpness levels to a wide variety of different types and constructions of knives.

At least some of the various embodiments disclosed herein allow the use of a replaceable and/or retractable rod. This can provide a number of benefits, including the ability to use different forms, types and/or shapes of rods, including ceramic rods and diamond coated rods, tapered rods, rods of different lengths, rods with different grits, and so on. Also, as very hard ceramic can be brittle, the ability to retract or remove a ceramic rod can reduce the possibility of damage due to the sharpening system being inadvertently dropped or otherwise subjected to a shock event.

The ability to retract a rod also can be a space-saving feature, which can be useful in both a kitchen setting where space may be at a premium, as well as in a portable setting where the sharpening system is taken on a camping trip or other outing. While it is contemplated that rods are relatively hard and durable, it is contemplated that from time to time such rods may become damaged or worn, necessitating replacement which can be easily effected.

Another benefit of the various embodiments disclosed herein is the ability to incorporate the guide surfaces adjacent the handle at the base (proximal end) of the rod (or other elongated member). This can enhance safety since the guides can serve as a hand guard, thereby protecting the hand of the user that grasps the handle. Moreover, the orientation of the sharpener will usually be such that the blade of the tool may be normally pointed and moved away from the hand and the body of the user during both primary and secondary sharpening against the respective abrasive surfaces. While the relative orientation of the abrasive surfaces to the handle has been disposed so as to be nominally aligned with a longitudinal axis of the handle so that the various embodiments disclosed herein are generally of a "sharpening steel" configuration, it will be appreciated that such is not limiting. For example, the various embodiments discussed herein can be adapted to direct the rods in a different direction from the handle, such as at a right angle (e.g., a "pistol orientation") or some other suitable angle.

While not limiting, it is contemplated that it may be beneficial to set the secondary guide angle to be equal to or greater than the primary guide angle associated with a previous sharpening operation to provide a so-called micro-bevel configuration to the finally sharpened tool, such as illustrated in FIG. 9B. This sequencing allows for some user error when honing on the sharpening rod with regard to presentation angle, force, contact uniformity, etc.

This sequencing also may facilitate an efficient subsequent re-sharpening with minimal (or no) material removal by use of the secondary abrasive. It will be appreciated that while such sequencing is preferred, such is not necessarily required. For example, it is readily contemplated that a sharpening sequence may take place at the greater angle followed by the lesser angle. This may operate to remove material and thin the blade, which may be desirable in some circumstances.

Various additional alternatives and configurations will readily occur to the skilled artisan upon a review of the present disclosure, and all such alternatives and configurations are encompassed by the present application. While the various embodiments disclosed herein have been generally directed to a sharpener suitable for sharpening a knife, it will be appreciated that other types of cutting tools can be readily sharpened as desired.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. A hand-held sharpener, comprising:

a handle having opposing first and second ends and an outer grip surface disposed between said ends adapted to be gripped by a hand of a user during use of the sharpener to sharpen a cutting tool, the handle comprising a guide surface adjacent the first end having a line contact portion that linearly extends at a single selected angle with respect to a central axis that extends through the first and second ends;

a first abrasive rod adapted to extend from the first end of the handle in a selected direction and having a first outer abrasive surface with a first abrasiveness level, the first outer abrasive surface extending to form a first non-orthogonal angle with respect to the guide surface; and a second abrasive rod adapted to extend from the first end of the handle in the selected direction and having a second outer abrasive surface with a different, second abrasiveness level, the second outer abrasive surface extending to form a second non-orthogonal angle with respect to the guide surface.

2. The sharpener of claim 1, wherein the first abrasive rod is characterized as a cylindrical rod and the second abrasive rod is characterized as a tapered rod.

3. The sharpener of claim 1, wherein at least one of the first or second abrasive rods is characterized as a ceramic rod.

4. The sharpener of claim 1, wherein the line contact portion of the guide surface extends to a proximal end of the first abrasive rod responsive to an alignment of the first outer abrasive with the guide surface, and wherein the line contact portion of the guide surface extends to a proximal end of the second abrasive rod responsive to a subsequent alignment of the second outer abrasive surface with the guide surface.

5. The sharpener of claim 1, wherein each of the first and second abrasive rods can be moved to a retracted position within the handle.

6. The sharpener of claim 1, wherein the guide surface is a first guide surface at the first non-orthogonal angle with respect to and located on a first side of the central axis, and wherein the handle further comprises a second guide surface at the first non-orthogonal angle with respect to and located on an opposing, second side of the central axis, the second guide surface having a second line contact portion that extends at the selected angle with respect to the central axis so that the guide surface and the second guide surface are mirrored on opposing sides of the central axis and respectively taper toward the first end of the handle.

7. The sharpener of claim 1, wherein the first and second abrasive rods are incorporated into a combined rod assembly rotatable with respect to the handle so that the respective first and second abrasive rods can be successively aligned with the guide surface responsive to a rotational position of the combined rod assembly.

8. The sharpener of claim 7, wherein the combined rod assembly is retractable into an interior cavity of the handle.

9. The sharpener of claim 7, wherein a selected one of the first or second outer abrasive surfaces is characterized as a flat, planar surface and a remaining one of the first or second outer abrasive surfaces is characterized as a curvilinearly extending surface.

10. The sharpener of claim 7, wherein the combined rod assembly comprises a substantially rectilinearly shaped main body having opposing first and second side surfaces and opposing third and fourth side surfaces, the first and second side surfaces characterized as tapered planar surfaces and the third and fourth side surfaces characterized as portions of cylindrical surfaces.

11. The sharpener of claim 1, wherein both the first outer abrasive surface and the second outer abrasive surface are nominally parallel to the central axis.

12. The sharpener of claim 1, wherein the second abrasive rod is characterized as a hollow tube configured to slidingly engage and cover the first abrasive rod.

13. The sharpener of claim 1, wherein each of the first and second abrasive rods are configured to be alternately removed from and attached to the first end of the handle to extend therefrom.

14. The sharpener of claim 1, wherein at least a selected one of the first abrasive rod or the second abrasive rod has a proximal end configured to be attached to the handle adjacent the line contact portion of the guide surface and an opposing distal end that supports an end cap member having a diameter greater than a diameter of the respective first abrasive rod or the second abrasive rod.

15. The sharpener of claim 1, wherein the first non-orthogonal angle is equal to the second non-orthogonal angle.

16. The sharpener of claim 1, wherein the first non-orthogonal angle is greater than the second non-orthogonal angle.

17. The sharpener of claim 1, wherein the selected angle is nominally 20 degrees with respect to the central axis.

18. The sharpener of claim 1, wherein the selected angle is nominally 25 degrees with respect to the central axis.

19. A hand-held sharpener comprising:

a handle having opposing first and second ends and an outer grip surface disposed between said ends adapted to be gripped by a hand of a user during use of the sharpener to sharpen a cutting tool, the handle comprising a first guide surface adjacent the first end having a line contact portion that extends linearly at a single selected angle with respect to a central axis which passes through the respective first and second ends;

a combined rod assembly which extends from the first end of the handle adjacent a distal end of the flat contact portion of the first guide surface, the combined rod assembly comprising a first abrasive surface having a first abrasiveness level and which extends at a first angle with respect to the first guide surface and a second abrasive surface having a different, second abrasiveness level and which extends at a different, second angle with respect to the first guide surface, the combined rod assembly aligned along the central axis.

20. The sharpener of claim 19, wherein the combined rod assembly is rotatable with respect to the handle so that the respective first and second abrasive rods can be successively aligned with the first guide surface responsive to a rotational position of the combined rod assembly.

21. The sharpener of claim 19, wherein the combined rod assembly is retractable into an interior cavity of the handle.

22. The sharpener of claim 19, wherein a selected one of the first or second outer abrasive surfaces is characterized as a flat, planar surface and a remaining one of the first or second outer abrasive surfaces is characterized as a curvilinearly extending surface.

* * * * *